US005623717A

United States Patent [19]

Takenaka et al.

[11] Patent Number: 5,623,717

[45] Date of Patent: Apr. 22, 1997

[54] DEVELOPING DEVICE FOR AN IMAGE FORMING APPARATUS WHICH USES BIAS VOLTAGES TO ATTRACT CHARGED TONER

[75] Inventors: Eiji Takenaka, Isehara; Yozo Matsuura, Tokyo, both of Japan

[73] Assignee: Ricoh Company, Ltd., Tokyo, Japan

[21] Appl. No.: 548,529

[22] Filed: Oct. 26, 1995

Related U.S. Application Data

[63] Continuation of Ser. No. 163,527, Dec. 9, 1993, abandoned.

[30] Foreign Application Priority Data

Dec. 11, 1992 [JP] Japan ..... 4-331771

[51] Int. Cl.[6] ..... G03G 15/08

[52] U.S. Cl. ..... 399/281

[58] Field of Search ..... 355/245, 246, 355/251, 253, 259; 118/653

[56] References Cited

U.S. PATENT DOCUMENTS

| | | | |
|---|---|---|---|
| 4,407,228 | 10/1983 | Takano et al. . | |
| 4,564,285 | 1/1986 | Yasuda et al. . | |
| 4,587,699 | 5/1986 | Kadomatsu et al. | 428/328 |
| 4,637,708 | 1/1987 | Yuasa . | |
| 4,760,422 | 7/1988 | Seimiya et al. | 355/246 |
| 4,827,868 | 5/1989 | Tarumi et al. . | |
| 4,912,003 | 3/1990 | Asanae et al. | 430/100 |
| 5,051,332 | 9/1991 | Hosoya et al. | 430/122 |
| 5,062,385 | 11/1991 | Nishio et al. . | |
| 5,142,330 | 8/1992 | Hirano et al. | 355/259 |
| 5,245,391 | 9/1993 | Suzuki | 355/246 |
| 5,315,061 | 5/1994 | Suzuki et al. | 118/651 |

OTHER PUBLICATIONS

Patent Abstracts of Japan, vol. 7, No. 125 (P–200), May 31, 1983, JP–58–42071, Mar. 11, 1983.

*Primary Examiner*—William J. Royer

*Attorney, Agent, or Firm*—Oblon, Spivak, McClelland, Maier & Neustadt, P.C.

[57] ABSTRACT

In a developing device for an electrophotographic image forming apparatus, a toner conveyor roller intervenes between a conveyor roller and a developing region where a photoconductive element is located. A toner is electrically transferred from the conveyor roller to the toner conveyor roller and conveyed by the toner conveyor roller to the developing region. This prevents inversely charged toner particles from being brought to the developing region, thereby insuring high quality development.

24 Claims, 3 Drawing Sheets

DEVELOPING DEVICE FOR AN IMAGE FORMING APPARATUS WHICH USES BIAS VOLTAGES TO ATTRACT CHARGED TONER

This application is a continuation of application Ser. No. 08/163,527, filed on Dec. 9, 1993, now abandoned.

BACKGROUND OF THE INVENTION

The present invention relates to a developing device for a facsimile apparatus, copier, printer or similar electrophotographic image forming apparatus.

Many of modern image forming apparatuses of the type described have a developing device operable with a toner, or one component type developer, having high electric resistance. This kind of developer basically eliminates the need for the maintenance of the developing device and reduces the size of the device. Some different types of developing devices have heretofore been proposed, as follows. A first type of developing device has a developing roller having an elastic surface and contacting a photoconductive drum, and a blade contacting the surface of the roller to form a thin uniform toner layer thereon. A bias voltage for development is applied to the developing roller. A second type of developing device has a developing roller having a hard surface and contacting a photoconductive belt, and a blade contacting the surface of the roller to form a thin uniform toner layer thereon; a bias voltage is also applied to the developing roller. A third type of developing device has first conveying means corresponding to a developing roller, and second conveying means intervening between the first conveying means and a photoconductive element and implemented as a belt, as disclosed in Japanese Patent Laid-Open Publication (Kokai) No. 61-34557. In this type of developing device, a toner is transferred from the first conveying means to the photoconductive element via the second conveying means or belt.

The first type of developing device described above have some problems since the surface of the developing roller is elastic, as follows. (1) It is difficult for the blade to form a thin uniform toner layer on the developing roller. (2) The surface of the roller creeps and fails to contact the photoconductive drum and blade uniformly, resulting in defective development. (3) It is difficult to charge the toner uniformly, i.e., toner particles charged to polarity opposite to desired polarity appear, contaminating the background of an image.

The second type of developing device can eliminate the above-stated problems (1) and (2), but it cannot eliminate the problem (3). Moreover, this type of device brings about another problem that (4) it needs a mechanism for driving the photoconductive belt (drive roller, gears, etc.) and a mechanism for balancing the tension of the belt, increasing the cost.

Even the third type of developing device cannot eliminate the above problem (4) although it can eliminate the problem (3).

SUMMARY OF THE INVENTION

It is, therefore, an object of the present invention to provide a developing device capable of eliminating all the problems discussed above.

A developing device for an image forming apparatus of the present invention comprises a toner conveying member for conveying a high resistance toner charged by friction or charge injection, and an elastic roller-like conveying member for causing the toner from the toner conveying member to deposit electrically thereon. The toner is conveyed by the roller-like conveying member to a developing region included in the image forming apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 5:
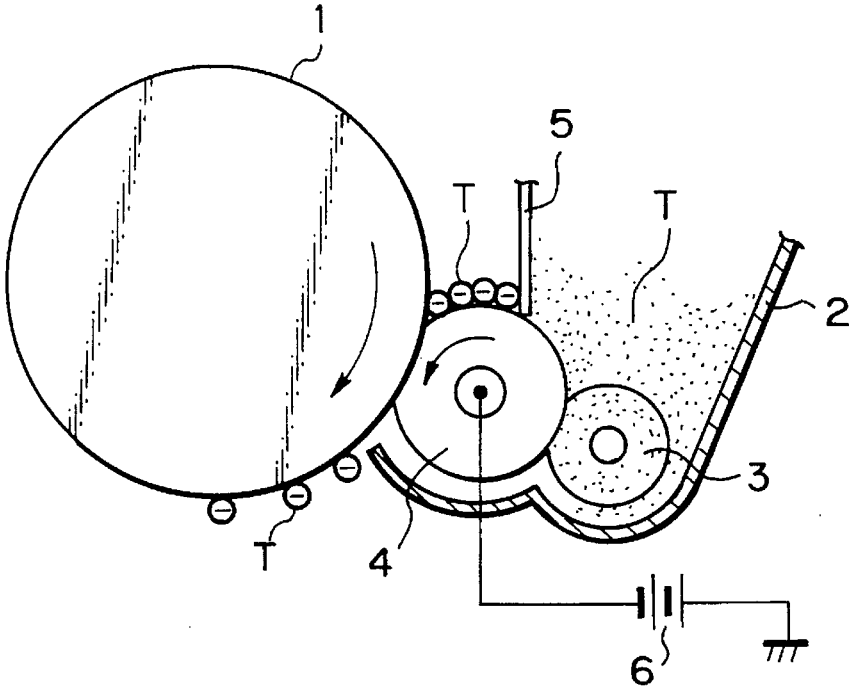
Fig. 5 PRIOR ART
FIG. 5 is a section showing a conventional developing device.

To better understand the present invention, a brief reference will be made to a conventional developing device, shown in FIG. 5. As shown, the developing device adjoins a photoconductive element 1 and has a casing 2 storing a toner, or one component type developer, T having high electric resistance. A toner supply roller 3 and a developing roller 4 are disposed in the casing 2. The developing roller 4 has a surface made of an elastic material. A blade 5 is held in contact with the developing roller 4. A bias power source 6 applies a bias voltage to the developing roller 4. The toner T is charged mainly by the friction of the toner supply roller 3 and developing roller 4. The bias voltage applied to the developing roller 4 causes the toner T to electrostatically deposit on the developing roller 4. While the developing roller 4 conveys the toner T toward a developing region where the drum 1 is located, the blade 5 forms a thin toner layer on the roller 4. Since the surface of the developing roller 4 is elastic, a nip width necessary for development is formed between the roller 4 and the drum 1 despite that the surface of the drum 1 is hard. This type of developing device, however, cannot eliminate the previously stated problems (1)–(3).

Figure 6:
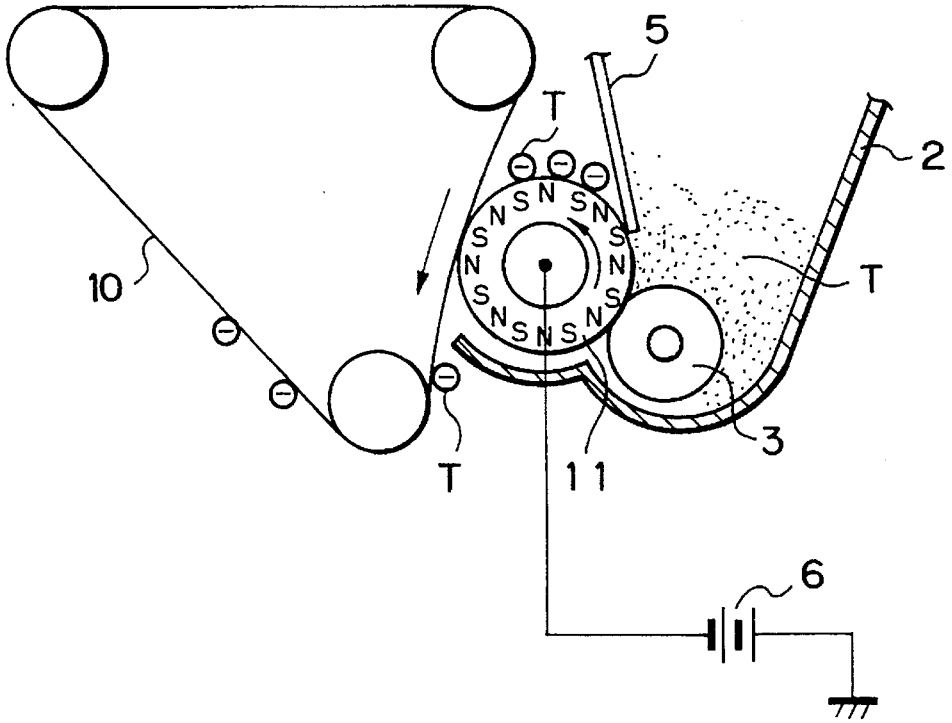
Fig. 6 PRIOR ART
FIG. 6 is a section showing another conventional developing device.

FIG. 6 shows another conventional developing device using a developing roller having a hard surface. In the figure, the same or similar constituents as the constituents of FIG. 5 are designated by the same reference numerals. As shown, the developing device has a developing roller 11 held in contact with a photoconductive element implemented as a belt 10. A magnetic toner T is deposited on the developing roller 11 by a magnetic force. The toner T is regulated by the blade 5 to form a thin layer on the developing roller 11 and charged mainly by the friction of the blade 5 and toner T and the friction of the toner T itself. The belt 10 conveys the toner T to the developing region where the belt 10 is located. A nip width necessary for development is provided by the belt 10 despite that the surface of the developing roller 11 is hard. However, this type of developing device cannot eliminate the previously stated problems (3) and (4).

Figure 1:
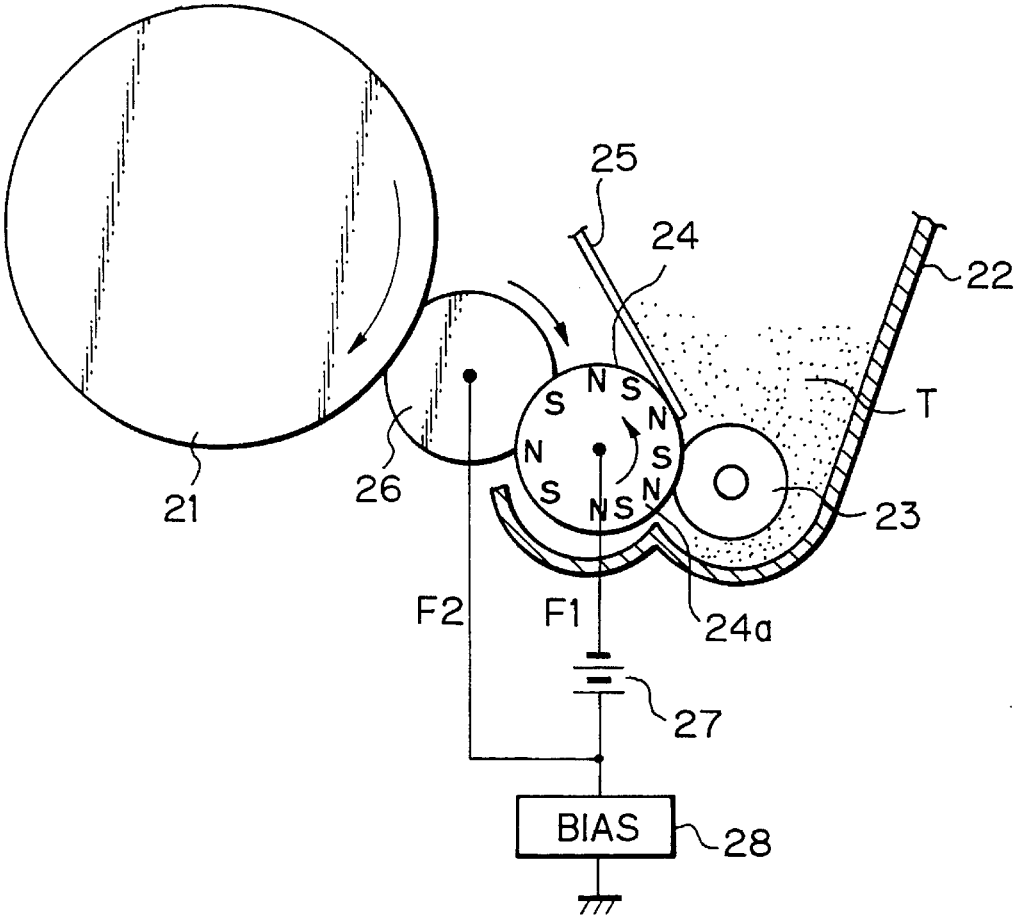
FIG. 1 is a fragmentary section of a developing device embodying the present invention.

Referring to FIG. 1, a developing device embodying the present invention will be described. As shown, the developing device adjoins a photoconductive drum 21 and has a casing 22 storing a toner T having high electric resistance. A toner supply roller 23, a conveyor roller 24, and a blade 24 are disposed in the casing 22. The conveyor roller, or conveying means, 24 is made of a hard material and provided with a magnetically polarized portion 24*a* on the surface thereof. The blade 25 remains in contact with the conveyor roller 24 at the end thereof. An elastic toner conveyor roller, or roller-like conveying means, 26 is also disposed in the casing 22 and interposed between the conveyor roller 24 and the drum 21. The toner conveyor roller 26 is elastically deformable to form a nip between the drum 21 and the conveyor roller 26. A power source 27 is connected to the conveyor roller 24 to apply a bias voltage F1 (V) thereto for the transfer of the toner T. A bias power source 28 is connected to the toner conveyor roller 26 to apply a bias voltage F2 (V) thereto for development.

The bias voltages F1 and F2 may have any one of the following relations:

(1) $F1<F2<0$ when the toner T is negatively charged and negative-to-positive development is effected;

(2) $0<F1<F2$ when the toner T is negatively charged and positive-to-positive development is effected;

(3) $0<F2<F1$ when the toner T is positively charged and negative-to-positive development is effected; and (4) $F2<F1<0$ when the toner T is positively charged and positive-to-positive development is effected.

Let the following description concentrate on the negatively charged toner T and negative-to-positive development by way of example.

Figure 2:
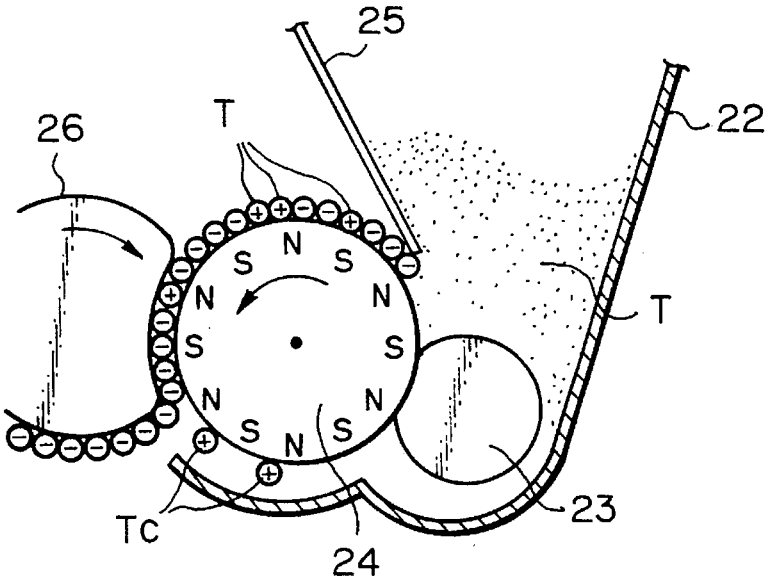
FIG. 2 is a view demonstrating the transfer of a toner to occur in the illustrative embodiment.
Figure 3:
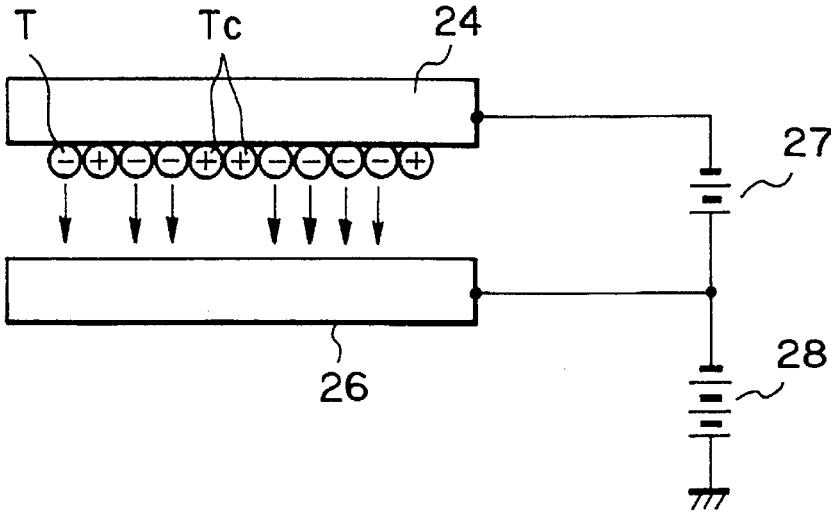
FIG. 3 illustrates how reversely charged toner particles are caught in the embodiment.

The operation of the embodiment will be described with reference also made to FIGS. 2 and 3. The toner T is fed to the toner supply roller 23 by the conveyor roller 24 and magnetically deposited on the roller 24. The conveyor roller 24, rotating in the direction indicated by an arrow in the figures, conveys the toner T toward the toner conveyor roller 26. The blade 25 regulates the thickness of the toner T while charging it by friction. As shown in FIG. 2, the charged toner T is electrostatically transferred from the roller 24 to the roller 26 and then conveyed by the roller 26 toward a developing region where the roller 26 contacts the drum 21. As shown in FIG. 3, when the toner T is transferred from the roller 24 to the roller 26, inversely charged particles Tc included in the toner T are left on the roller 24 without being transferred to the roller 26. It is to be noted that the rotation directions of the rollers 24 and 26 shown and described are only illustrative and not limitative.

FIGS. 4A–4D each shows a specific configuration of the toner conveyor roller 26. How the bias voltage is applied from the power source 28 to the roller 26 will be described with reference to FIGS. 4A–4D.

Figure 4A:
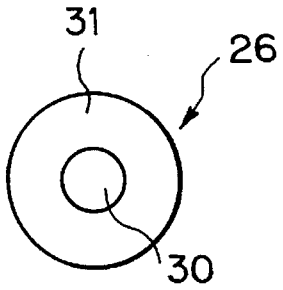
FIGS. 4A–4D are cross-sections each showing a specific configuration of a toner conveyor roller included in the embodiment.

The roller 26 shown in FIG. 4A has a metallic core 30, and a conductive and/or dielectric (semiconductive and semidielectric) elastic layer 31 provided on the core 30. When the elastic layer 31 is dielectric, the core 30 has to be conductive. When both the core 30 and the elastic layer 31 are conductive (including semiconductive and semidielectric), the bias voltage from the power source 28 is applied to the core 30 or the elastic layer 31. When only the elastic layer 31 is conductive (including semiconductive and semidielectric), the bias voltage is applied to the layer 31. Further, when the elastic layer 31 is dielectric, the bias voltage is applied to the core 30.

Figure 4B:
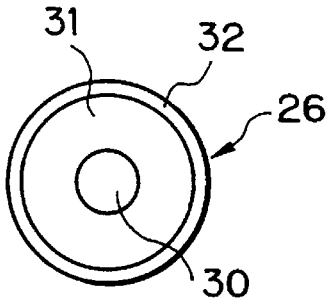

In FIG. 4B, the roller 26 has, in addition to the core 30 and elastic layer 31, a conductive or dielectric layer 32 provided on the elastic layer 31. When the outermost layer 32 is dielectric, the elastic layer 31 has to be conductive (including semiconductive and semidielectric). The bias voltage from the power source 28 is applied to one of the core 30, elastic layer 31 and conductive layer 32 when both the core 30 and the elastic layer 31 are conductive (including semiconductive and semidielectric). When only the elastic layer 31 is conductive (including semiconductive and semidielectric), the bias voltage is applied to the elastic layer 31 or the conductive layer 32. Further, when the elastic layer 31 is not conductive (including semiconductive and semidielectric), the bias voltage is applied to the conductive layer 32. The conductive layer 32 may be implemented by a conductive film made of resin or a semiconductive and semidielectric film also made of resin.

Figure 4C:
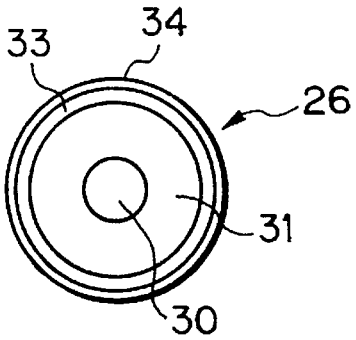

The roller 26 shown in FIG. 4C has an elastic conductive layer 33 and a dielectric layer 34 in addition to the core 30 and elastic layer 31. The elastic conductive layer 33 is provided on the elastic layer 31 while the dielectric layer 34 is provided on the conductive layer 33. The bias voltage from the power source 28 is applied to the dielectric layer 31 or the conductive layer 33 when both the core 30 and the elastic layer 31 are conductive (including semiconductive and semidielectric), to the elastic layer 31 or the conductive layer 33 when only the elastic layer 31 is conductive (including semiconductive and semidielectric), or to the conductive layer 33 when the elastic layer 31 is not conductive (including semiconductive and semidielectric). The conductive (including semiconductive and semidielectric) layer 33 and dielectric layer 34 may be implemented by a film made up of a conductive or semiconductive and semidielectric elastic substrate and a dielectric layer provided thereon.

Figure 4D:
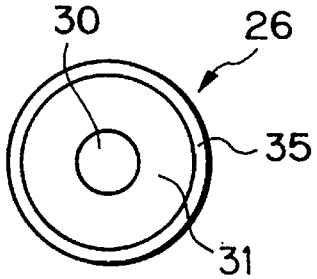

Further, the roller 26 shown in FIG. 4D has a semiconductive and semidielectric layer 35 provided on the elastic layer 31 which surrounds the core 30. The bias voltage is applied to one of the the core 30, elastic layer 31 and semiconductive and semidielectric (including dielectric) layer 35 when both the core 30 and the elastic layer 31 are conductive (including semiconductive and semidielectric). When only the elastic layer 31 is conductive (including semiconductive and semidielectric), the bias voltage is applied to the elastic layer 31 or the semiconductive and semidielectric layer 35. When the elastic layer 31 is not conductive (including semiconductive and semidielectric), the bias voltage is applied to the semiconductive and semidielectric layer 35.

In any one of the roller configurations shown in FIGS. 4A–4D, the layers 31–35 may be constituted by independent members or may be formed integrally with each other. If desired, an extra member for reinforcement, for example, may be interposed between the adjoining layers so long as it does not influence the expected functions of the layers.

In summary, in accordance with the present invention, a toner conveyor roller intervenes between a conveyor roller and a developing region where a photoconductive element is located. A toner is electrically transferred from the conveyor roller to the toner conveyor roller and conveyed by the toner conveyor roller to the developing region. This prevents inversely charged toner particles from being brought to the developing region, thereby insuring high quality development. Moreover, since the toner conveyor roller is elastic, a photoconductive element in the form of a drum can be used which simplifies the construction and reduces the cost and size, compared to a photoconductive belt.

Various modifications will become possible for those skilled in the art after receiving the teachings of the present disclosure without departing from the scope thereof.

What is claimed is:

1. A developing device for an image forming apparatus, comprising:

a first bias voltage generator;

toner conveying means for conveying a high resistance toner charged by friction or charge injection, said toner conveying means being charged with a first bias voltage from said first bias voltage generator;

a blade contacting the toner conveying means which regulates a thickness of toner on the toner conveying means;

a second bias voltage generator; and elastic roller-like conveying means for causing the toner from said toner conveying means to deposit electrically thereon, whereby said toner is conveyed by said roller-like conveying means to a developing region included in said image forming apparatus, said elastic roller-like conveying means being charged with a second bias voltage from said second bias voltage generator, said second bias voltage different from said first bias voltage, which causes portions of said toner which have a predetermined charged to be more strongly attracted to said elastic roller-like conveying means than to said toner conveying means, wherein a conveying surface of the toner conveying means is harder than a conveying surface of the elastic roller-like conveying means.

2. A device as claimed in claim 1, wherein said roller-like conveying means comprises a metallic core, and a conductive elastic layer or a semiconductive and semidielectric elastic layer provided on said metallic core.

3. A device as claimed in claim 2, wherein said second bias voltage is applied to said elastic layer to cause the toner to deposit electrically.

4. A device as claimed in claim 2, wherein said metallic core is conductive or semiconductive and semidielectric, wherein said second bias voltage is applied to said metallic core to cause the toner to deposit electrically.

5. A device as claimed in claim 1, wherein said roller-like conveying means comprises a metallic core, an elastic layer provided on said metallic core, and one of a conductive layer and a semiconductive and semidielectric layer provided on said elastic layer.

6. A device as claimed in claim 5, wherein said second bias voltage is applied to said conductive layer or said semiconductive and semidielectric layer to cause the toner to deposit electrically.

7. A device as claimed in claim 5, wherein said elastic layer is conductive or semiconductive and semidielectric, wherein said second bias voltage is applied to said elastic layer to cause the toner to deposit electrically.

8. A device as claimed in claim 5, wherein said metallic core and said elastic layer are conductive or semiconductive and semidielectric, wherein said second bias voltage is applied to said metallic core to cause the toner to deposit electrically.

9. A device as claimed in claim 5, wherein said roller-like conveying means further comprises one of a conductive film forming a conductive layer and a semiconductive and semidielectric film forming a semiconductive and semidielectric layer provided on said elastic layer.

10. A device as claimed in claim 9, wherein said conductive film and said semiconductive and semidielectric film each comprises a film made of resin.

11. A device as claimed in claim 1, wherein said roller-like conveying means comprises a metallic core, a conductive or semiconductive and semidielectric elastic layer provided on said metallic core, and a dielectric layer provided on said elastic layer.

12. A device as claimed in claim 11, wherein said second bias voltage is applied to said elastic layer to cause the toner to deposit electrically.

13. A device as claimed in claim 11, wherein said metallic core is conductive or semiconductive and semidielectric, wherein said second bias voltage is applied to said metallic core to cause the toner to deposit electrically.

14. A device as claimed in claim 1, wherein said roller-like conveying means comprises a metallic core, an elastic layer provided on said metallic core, one of a conductive elastic layer and a semiconductive and semidielectric elastic layer provided on said elastic layer, and a dielectric layer provided on said one of said conductive elastic layer and said semiconductive and semidielectric layer.

15. A device as claimed in claim 14, wherein said second bias voltage is applied to said conductive elastic layer or said semiconductive and semidielectric elastic layer to cause the toner to deposit electrically.

16. A device as claimed in claim 14, wherein said elastic layer is conductive or semiconductive and semidielectric, wherein said second bias voltage is applied to said elastic layer to cause the toner to deposit electrically.

17. A device as claimed in claim 14, wherein said metallic core and said elastic layer are conductive or semiconductive and semidielectric, wherein said second bias voltage is applied to said metallic core to cause the toner to deposit electrically.

18. A device as claimed in claim 14, wherein said one of said conductive elastic layer and said semiconductive and semidielectric layer and said dielectric layer comprise a film having a conductive or semiconductive and semidielectric elastic substrate, and a dielectric layer formed on said substrate.

19. A device according to claim 1, wherein said elastic roller-like conveying means has charges distributed uniformly thereon.

20. A device according to claim 1, wherein:

said second bias voltage attracts said portions of said toner which have a desirable charge to said elastic roller-like conveying means; and said first bias voltage prevents said portions of said toner which have an undesirable charge from transferring to said elastic roller-like conveying means.

21. A device according to claim 1, wherein:

said elastic roller-like conveying means comprises a uniform outermost elastic layer.

22. A device according to claim 1, wherein:

said toner conveying means and said elastic roller-like conveying means are rollers.

23. A developing device for an image forming apparatus using toner, comprising:

a photoconductive drum;

a first toner conveying roller made of a hard material and having a magnetic surface;

a blade held in contact with said first toner conveying roller and for frictionally charging the toner deposited on said first toner conveying roller while leveling said toner to form a thin toner layer; and a second toner conveying roller elastically engaged with said photoconductive drum and said first toner conveying roller, and for receiving the toner frictionally charged by said blade from said first toner conveying roller and conveying said toner to said photoconductive drum.

24. A developing device for an image forming apparatus, comprising:

toner conveying means for conveying a high resistance toner charged by at least one of friction and charge injection;

a blade contacting the toner conveying means which regulates a thickness of toner on the toner conveying means;

elastic roller-like conveying means for causing the toner from said toner conveying means to deposit electrically thereon, said elastic roller-like conveying means conveying the toner to a developing region included in said image forming apparatus; and bias voltage generating means, connected to the elastic roller-like conveying means, for generating a bias voltage having a predetermined polarity by which the toner from said toner conveying means is electrically deposited on said elastic roller-like conveying means, said bias voltage generating means producing a voltage difference between said toner conveying means and said elastic roller-like conveying means which causes portions of the toner which have a predetermined charge to be more strongly attracted to said elastic roller-like conveying means than to said toner conveying means.

* * * * *